US005299324A

United States Patent [19]

Zinna

[11] Patent Number: 5,299,324

[45] Date of Patent: Apr. 5, 1994

[54] RACE NUMBER BELT WITH RACE NUMBER ATTACHMENT SYSTEM

[76] Inventor: Leonard C. Zinna, 1651 S. Juniper St. #20, Escondido, Calif. 92025

[21] Appl. No.: 912,303

[22] Filed: Jul. 13, 1992

[51] Int. Cl.[5] ..... A41F 9/00

[52] U.S. Cl. ..... 2/312; 2/314; 2/315; 2/317; 2/318; 2/319; 2/321; 2/322; 2/311; 40/640; 40/586

[58] Field of Search ..... 2/312, 314, 315, 316, 2/317, 311, 318, 319, 321, 322; 40/640, 586

[56] References Cited

U.S. PATENT DOCUMENTS 1,525,464 2/1925 Parke ..... 2/315

2,846,224 8/1958 Roselle ..... 2/315

4,651,989 3/1987 Wilson ..... 2/321

*Primary Examiner*—Clifford D. Crowder

*Assistant Examiner*—Gloria Hale

[57] ABSTRACT

An elastic (1) belt with a buckle (2) and having an adjustment slide (3) for waist size adjustment and "Race Number Attachment System" (4 and 5) which consists of 2 small dangling elastic pieces which are stitched (7B and 7C) at one end to the belt. These 2 dangling elastic pieces (4) are fed through the 2 top holes in a race number indicator sign. The 2 dangling elastics (4) are long enough to accept a variety of different size race numbers. The number is held in place and adjustment made using 2 cord locks (5A and 5B).

1 Claim, 1 Drawing Sheet

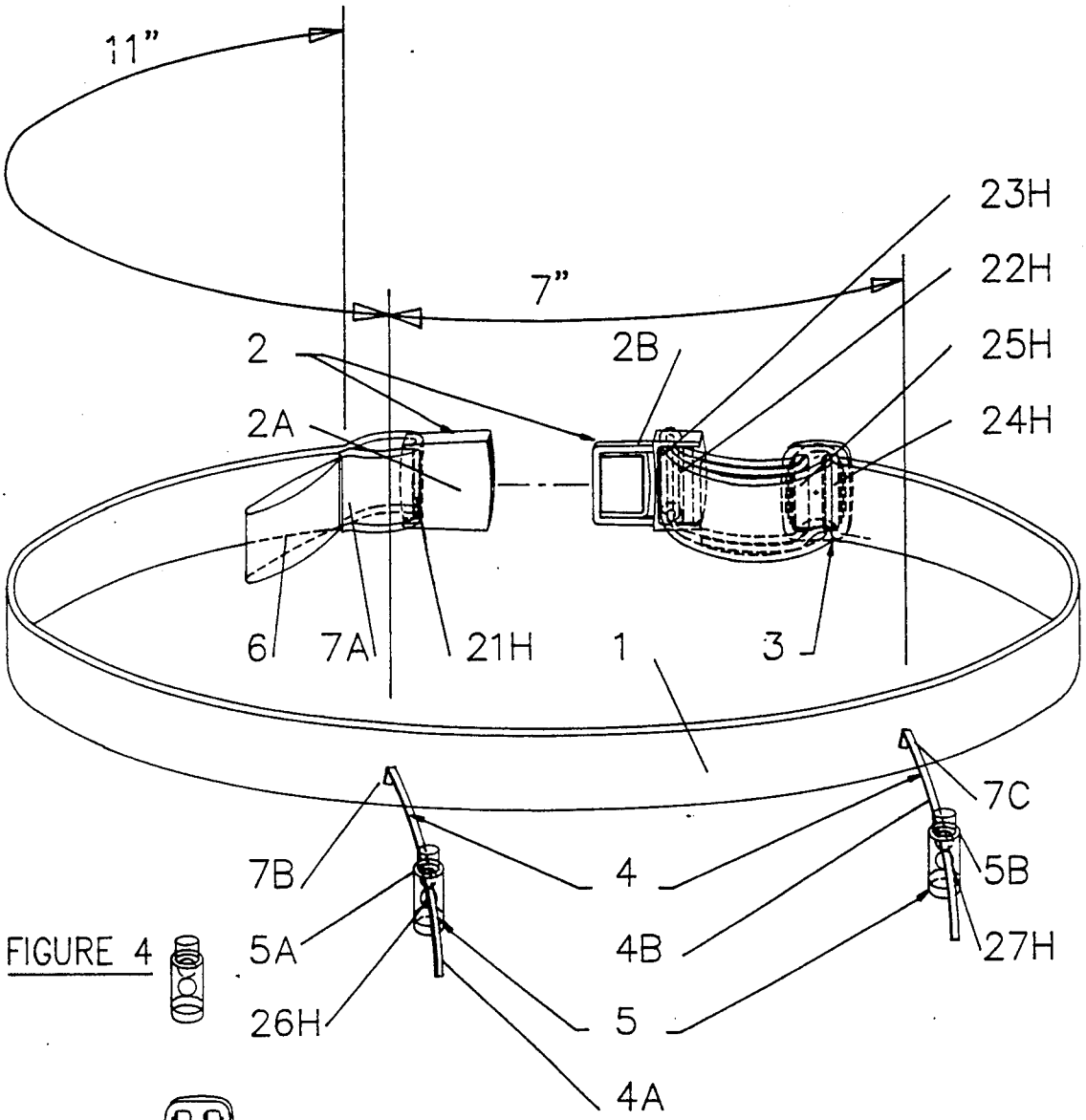
FIGURE 1
FIGURE 4
FIGURE 3
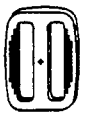
FIGURE 2
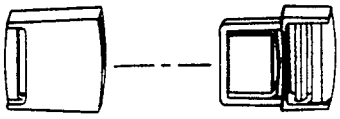

RACE NUMBER BELT WITH RACE NUMBER ATTACHMENT SYSTEM

BACKGROUND FIELD OF INVENTION

This invention relates to a system used on a belt to attach a race number used by athletes in competition or anywhere a race number is required.

BACKGROUND—DESCRIPTION OF PRIOR ART

During athletic events athletes are often required to wear a number to positively be identified. Race organizers supply these numbers to contestants in an athletic event. Some examples of athletic events are Triathlons, Duathlons, Running or Bicycle races. But not confined to these.

These race numbers are commonly made from paper approx 8 inches by 6 inches with one hole in each corner but can vary in size and are attached using safety pins often supplied by the race organizer.

The competitors find the use of safety pins very cumbersome and they do not like the idea of having to put pin holes through their clothing which is often expensive. Pins start holes in material and if left in after an athletic event combine with perspiration and cause rust stains on the garment. Also a major draw back of using pins are when the event is a multi-sports event such as a Triathlon. Which is a sport were the contestant must swim, bicycle and then run and must be wearing a race number when they cross the finish line.

Since it is not practical to swim with a number attached to your swim suit or wet suit, athletes would use make shift belts using underwear elastic rubber bands and would pin the race number to the makeshift belt. These belts often were cumbersome to put on in a race when time is of the essence. When the contestant would try to put on the belt over their heads or step into it inadvertently the race number would be twisted around the belt. Some athletes would make their own belts using elastic and hook and loop fasteners and since the number was attached in the middle of the belt the hook and loop fastener would have to be closed in back so as to allow the race number to be in front. And often when trying to close the hook and loop fastener, the fastener would be crossed and would not hold, as well as when the hook and loop fastener would get saturated with perspiration or drinking water. And often this would have to be done while running from a transition. Besides the fact that these belts would not work very well their was no way to attach the race number without the cumbersome use of pins.. It also was not adjustable so it would not be able to fit a variety of waist sizes as well as often not being very aestheticly appealing.

OBJECTS AND ADVANTAGES

Several objects and advantages of my invention are:

(a) to provide a quick method of attaching a race number without the use of pins.

(b) to provide a belt which is quick and easy to put on while on the run.

(c) to provide a comfortable belt that can be worn against the skin.

(d) to provide a belt that is adjustable and able to fit a variety of waist sizes.

(e) to provide an attachment system that can accommodate a variety of different size race numbers.

(f) to provide a belt that can be custom printed and can be use as a promotional item.

(g) to provide a belt in a variety of colors.

Further objects and advantages of my invention will become apparent from a consideration of the drawing and ensuing description.

DRAWING FIGURES

FIG. 1 is a perspective inside view of the buckle and the elastic belt threading technic and outside view of the "Race Number Attachment System" fasteners.

FIG. 2 is an inside view of the buckle (LOW PROFILE CENTER RELEASE BUCKLE)

FIG. 3 is an inside view of the adjustment slide buckle (LOW PROFILE TRIGLIDE)

FIG. 4 is a front view looking through the hole in the cord lock fastener (MINI CORD LOC)

REFERENCE NUMERALS IN DRAWINGS

1 " inch by 36" inch woven elastic
2 Buckle (LOW PROFILE CENTER RELEASE BUCKLE)
2A Female part of buckle 2
2B Male part of buckle 2
3 Adjustment slide (LOW PROFILE TRIGLIDE)
4 ⅛ by 3" woven elastic
4A and 4B ⅛by 3" woven elastic
5 Cord Lock cord lock (MINI CORD LOC)
5A and 5B Cord locks (MINI CORD LOC)
6 Label
7A, 7B, 7C Stitch
21H–27H Opening

DESCRIPTION—FIGS. 1, 2, 3 AND 4

A Typical embodiment of this invention is illustrated in FIG. 1. The belt is made of 1 inch woven elastic 1 and is 36 inches in length that is cut from a roll of 36 yards with a hot knife so as to burn the end so it can not unravel. The elastic 1 can be purchased from South Carolina Elastic of Landrum, S.C.. The belt is fastened using a buckle (LOW PROFILE CENTER RELEASE BUCKLE) 2 that has both a male 2B and female 2A portion and is available from ITW Nexus of Wood Dale, Ill. The elastic 1 is threaded from the outside and down opening 21H in the female buckle portion 2A and folded over approximately 1 inch. A label 6 is placed between the folded elastic and stitched at 7A. This attaches the female (receptor) end 2A of the buckle to the elastic 1. The male end of the belt 2B and a adjustment slide (LOW PROFILE TRIGLIDE) 3 are threaded opposite the female end 2A. To do this thread the elastic 1 from the inside of the adjustment slide (LOW PROFILE TRIGLIDE) 3 up through opening 24H and down through opening 25H in the adjustment slide (LOW PROFILE TRIGLIDE) 3 continue from the inside of male 2B up through opening 22H and down through opening 23H. Continue up through opening 24H in adjustment slide (LOW PROFILE TRIGLIDE) 3 and down opening 25H. The adjustment slide (LOW PROFILE TRIGLIDE) 3 and male 2B of buckle 2 is secured. To attach the "Race Number Attachment System (4 and 5) which consists of the following: Two ⅛ inch by 3 inch elastics 4A and 4B are then cut using a hot knife to prevent the ends from unravelling. Measuring 11 inches from stitch 7A, and up or down ½ inch on the elastic 1. One ⅛ inch elastic 4A is stitched 7B onto the elastic 1. Measuring 7 inches further and up or down ½ inch on the elastic 1 the other ⅛ inch elastic 4B is stitched 7C. Compressed and slid over these two dangling ⅛ inch elastics 4A and 4B are two cord locks (MINI CORD LOC) 5A and 5B that can be also purchased from ITW Nexus of Wood Dale, Ill.

OPERATION—FIG. 1

To use the "Race Number Belt" with "Race Number Attachment System". One must first put the Race Number Belt" around the waist. Insert the male end 2B of the buckle (LOW PROFILE CENTER RELEASE BUCKLE) 2 into the female end 2A (A click will be heard when the buckle is successfully engaged). The buckle 2 can either be engaged in front of the body and with one hand spun around so the number is in front of the body or the buckle can be engaged in back of the body. (Number can be worn front or back) If the belt is to tight or loose the elastic 1 can be adjusted using the adjustment slide (LOW PROFILE TRIGLIDE) 3. To make belt tighter continue to thread elastic 1 further through adjustment slide (LOW PROFILE TRIGLIDE) 3 and male 2B while sliding adjustment slide (LOW PROFILE TRIGLIDE) 3 down elastic 1 away from male 2B. To loosen belt slide adjustment slide (LOW PROFILE TRIGLIDE) 3 up elastic 1 toward male 2B while lengthening elastic 1.

Now that the "Race Number Belt" is around the waist and comfortable the race number can be attached to the belt. Using the thumb and pointer finger squeeze the cord loc (MINI CORD LOC) 5A on the top and bottom and slide it off the ⅛ inch elastic 4A. Now slide the other cord loc (MINI CORD LOC) 5B off the other ⅛ inch elastic 4B in the same manner as the first. Pick up the race number you wish to attach. And with the number facing out and away from the body feed the ⅛ inch elastic 4B through the top hole in the race number. Then pick up the cord lock (MINI CORD LOC) 5B compress it on top and bottom expose a round opening 27H and thread the ⅛ inch elastic 4B through the opening in the cord lock (MINI CORD LOC) 5B and slide the cord lock (MINI CORD LOC) down until it touches the race number and then release it. Now feed the ⅛ inch elastic 4A through the other top hole in the race number. Now compress the cord lock (MINI CORD LOC) 5A on top and bottom and thread ⅛ inch elastic 4A through the opening 26H in cord lock (MINI CORD LOC) 5A. Slide the cord lock (MINI CORD LOC) 5A down until it touches the race number and release it. The cord locks (MINI CORD LOC) are adjustable along length of ⅛ inch elastics (4A and 4B) so as to adjust to variations in the size of race numbers.

The "Race Number Belt" is now ready for use.

SUMMARY, RAMIFICATIONS, AND SCOPE

Accordingly, the reader will see that the "Race Number Belt" with "Race Number Attachment System" of this invention can be used quickly and easily to attach a race number without the use of pins. And can be utilized in a quick manner (on the run) when time is of the essence. As well as supplying a very attractive accessory.

Further more the "Race Number Belt" and Race Number Attachment System has the additional advantages in that:

* it provides a belt that can be comfortably worn in athletic competition;
* it permits 2 adjustments one for waist size (one size fits all) and the other for the variation in race number size;
* it also provides a elastic surface that can be printed on with various promotions;
* it also can be provided in an assortment of colors;

Although the description above contains many specificities, these should not be construed as limiting the scope of the invention but as merely providing illustrations of some of the presently preferred embodiments of this invention. For example, the "Race Number Attachment System" can be applied to other forms of clothing such as shirts, singlets and shorts Etc.; the ⅛ inch elastic 4A and 4B can be shorter or longer as well substituted with a non stretch material with some degree of success; the buckle 2 elastic 1 and adjustment slide (MINI TRIGLIDE) 3 can also be substituted with some degree of success.

Thus the scope of the invention should be determined by the appended claims and their legal equivalents, rather than by the examples given.

I claim:

1. An elastic belt for attachment around a waist of a wearer comprised of an elongated elastic strip having two ends and a central portion wherein a male buckle component is attached at one end and a female buckle component is attached at the other end for attachment to said male buckle component; a length adjustment slide device on said elastic strip for waist size adjustment of the belt; and a race number indicator sign attachment means attached to said central portion consisting of two elongated elastic pieces of material having two opposite ends wherein one end is stitched to an outer surface of the central portion of said belt, wherein each elastic piece is of a width and length adapted to be fed through holes in a race number indicator sign in order to attach the sign to said belt and wherein said attachment means also includes a cord lock fastener on each elastic piece for encompassing said elastic pieces after said elastic pieces are threaded through the holes in the indicator sign and wherein the cord locks are adjustable along the length of the elastic pieces and thereby provide a secure attachment of various sizes of indicator signals to said belt.

* * * * *